US008863464B2

(12) United States Patent
Balducci, Jr.

(10) Patent No.: US 8,863,464 B2
(45) Date of Patent: Oct. 21, 2014

(54) INTERLOCKING MASONRY UNIT

(71) Applicant: Joe Balducci, Jr., Cleveland, MS (US)

(72) Inventor: Joe Balducci, Jr., Cleveland, MS (US)

( * ) Notice: Subject to any disclaimer, the term of this patent is extended or adjusted under 35 U.S.C. 154(b) by 0 days.

(21) Appl. No.: 13/644,322

(22) Filed: Oct. 4, 2012

(65) Prior Publication Data

US 2014/0096468 A1 Apr. 10, 2014

(51) Int. Cl.
*E04B 5/04* (2006.01)
*E04C 2/04* (2006.01)
*E04B 2/40* (2006.01)

(52) U.S. Cl.
CPC ..... *E04B 2/40* (2013.01)
USPC ..... 52/604; 52/603; 52/605; 52/607; 52/592.6

(58) Field of Classification Search
USPC ..... 52/603–607, 609, 592.6, 745.1, 747.12, 52/592.5, 596
See application file for complete search history.

(56) References Cited

U.S. PATENT DOCUMENTS

| | | | | | |
|---|---|---|---|---|---|
| 1,421,986 | A | * | 7/1922 | Phillips | 52/375 |
| 3,924,056 | A | | 12/1975 | LoCicero | |
| 3,936,987 | A | | 2/1976 | Calvin | |
| 4,075,808 | A | * | 2/1978 | Pearlman | 52/439 |
| 4,107,894 | A | | 8/1978 | Mullins | |
| 4,186,540 | A | | 2/1980 | Mullins | |
| 4,485,604 | A | * | 12/1984 | Palamara et al. | 52/436 |
| 4,631,885 | A | | 12/1986 | Iannarelli | |
| 4,651,485 | A | | 3/1987 | Osborne | |
| 5,115,614 | A | | 5/1992 | McGrath | |
| 5,457,926 | A | | 10/1995 | Jensen | |
| 5,567,089 | A | * | 10/1996 | Akamine | 405/285 |
| 5,711,129 | A | | 1/1998 | Woolford | |
| 5,855,102 | A | * | 1/1999 | Chang | 52/604 |
| D463,040 | S | | 9/2002 | Cerrato | |
| 6,526,720 | B2 | | 3/2003 | Maddy | |
| 6,871,468 | B2 | | 3/2005 | Whitson | |
| 6,962,028 | B2 | | 11/2005 | Banova | |
| 7,007,436 | B1 | | 3/2006 | Kelley | |
| 7,073,301 | B1 | | 7/2006 | Price | |
| 7,517,176 | B2 | | 4/2009 | Henderson | |
| 7,712,281 | B2 | | 5/2010 | Bott | |
| 8,074,419 | B1 | * | 12/2011 | Humphress et al. | 52/607 |
| 2002/0000073 | A1 | | 1/2002 | Maddy | |
| 2004/0128936 | A1 | | 7/2004 | Gilbert | |
| 2005/0102949 | A1 | | 5/2005 | Whitson | |
| 2007/0017176 | A1 | | 1/2007 | Gray | |
| 2008/0028710 | A1 | | 2/2008 | Alexander | |
| 2008/0098686 | A1 | | 5/2008 | Metten | |
| 2009/0113835 | A1 | | 5/2009 | Banova | |
| 2009/0193740 | A1 | | 8/2009 | Bennett | |
| 2012/0031031 | A1 | * | 2/2012 | Rulon | 52/503 |

* cited by examiner

*Primary Examiner* — Brian Glessner
*Assistant Examiner* — Brian D Mattei
(74) *Attorney, Agent, or Firm* — Ashley Law Firm P.C.; Stephen S. Ashley, Jr.

(57) ABSTRACT

A multi-purpose interlocking masonry unit includes support members extending from its lower surface and port depressions formed in its upper surface. Each masonry unit can be placed on top of a previously placed masonry unit. The interlocking masonry unit allows for the rapid creation of a wall that is substantially straight and aligned while minimizing the need to perform precise measurements and make alignment adjustments during the creation process. Bonding material can be poured through the resultant wall ports, creating a matrix pattern of bonding material throughout the wall, which results in a stronger more durable construction.

15 Claims, 4 Drawing Sheets

INTERLOCKING MASONRY UNIT

FIELD OF THE INVENTION

The present invention relates generally to an interlocking masonry unit. One embodiment of the invention comprises an interlocking masonry unit for use in mortared or similar wall construction which reduces the need for constant measurements and alignment, resulting in a wall with increased strength.

BACKGROUND OF THE INVENTION

The creation of buildings by utilizing walls made of concrete or similar stonework is a popular method of construction. Many traditional masonry walls are created using masonry units commonly referred to as cinder blocks. A cinder block is a masonry unit in the shape of a rectangular prism with two vertical chambers. A wall is constructed by creating successive rows of cinder blocks. Often each row of cinder blocks is offset by half a block from the previous row to increase stability. Some form of mortar or similar bonding material is placed between each row of blocks to bond the blocks into a solid structure.

One of the primary difficulties of creating cinder block walls is that constant measurements and adjustments must be made as the construction process is undertaken. Bonding material must be laboriously applied between each new block and all adjacent blocks. The craftsman must constantly adjust the wall as each block is placed to ensure that each row is level and straight. Failure to make constant adjustments often results in a wall that is uneven, non-level, angular, or otherwise unstable and not ascetically pleasing. This process is both time consuming for the craftsman and subject to significant human error. The resulting wall is also only as strong as the weakest bonded joint between two adjacent blocks.

Therefore, what is needed is an interlocking masonry unit. The interlocking masonry unit should connect with adjacent masonry units in a standard way that reduces the need for precision and skill. The interlocking masonry unit should also be designed to accept bonding material that is poured into the wall after each course of the wall is completed in order to reduce overall construction time. The interlocking masonry unit should also be designed to allow the bonding material to pour inside of and between the masonry units in both the horizontal and vertical dimensions to create a strong wall that is bonded together internally in all directions forming a matrix. Furthermore, other desirable features and characteristics of the present invention will become apparent when this background of the invention is read in conjunction with the subsequent detailed description of the invention, appended claims, and the accompanying drawings.

SUMMARY OF THE INVENTION

The present invention provides an interlocking masonry unit that advantageously overcomes the aforementioned deficiencies. Each interlocking masonry unit may be placed in connection with an adjacent masonry unit in a standard manner that reduces the need for constant measurement and adjustment for alignment purposes. Additionally, bonding material may be poured as the wall is created so that the need for adjustment is clear to the craftsman before the units become permanently bonded together. The interlocking masonry unit also provides both horizontal and vertical cavities to accept bonding material in order to create a matrix of bonding material to increase the overall strength of the wall.

The present invention is described more fully hereinafter with reference to the accompanying drawings, which are intended to be read in conjunction with both this summary, the detailed description, and any preferred and/or particular embodiments specifically discussed. The invention may, however, be embodied in many different forms and should not be construed as limited to the embodiments set forth herein; rather, these embodiments are provided by way of illustration only and not limitation.

BRIEF DESCRIPTION OF THE DRAWINGS

The drawings contained herein illustrate an embodiment of the invention. The invention is not limited to the particular embodiment shown in the drawings. The embodiment shown is an example, and the invention is capable of many variations of said embodiment in the drawings;

FIG. 5 also shows the use and placement of rebar reinforcement in the wall system for added strength.

Figure 1:
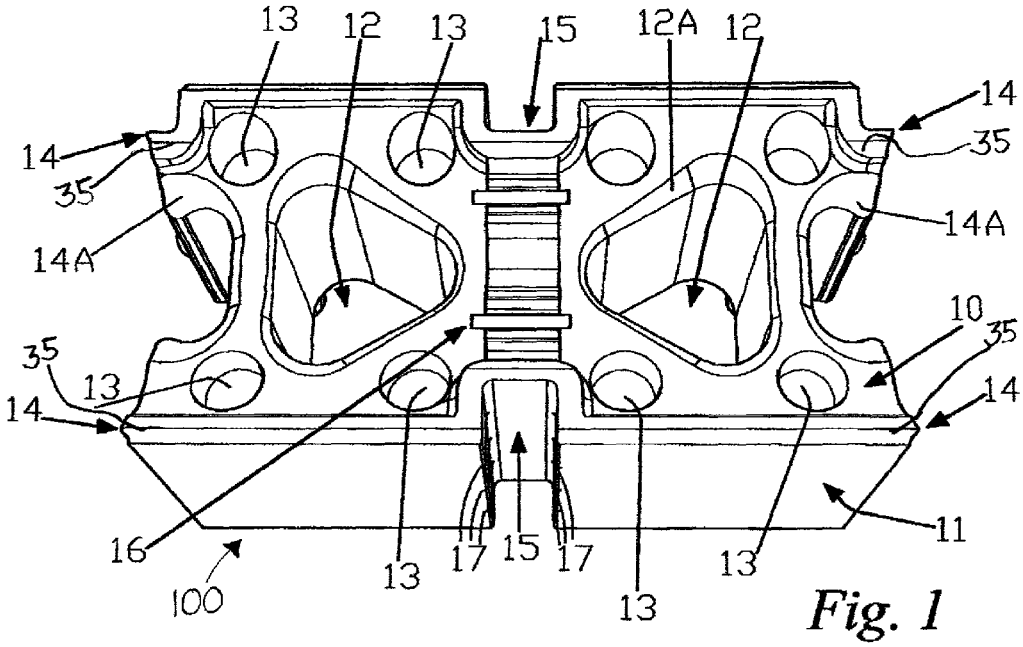
FIG. 1 illustrates a perspective view of the concave upper surface and a side surface of an interlocking masonry unit according to an embodiment of the present invention.

The first digit of each reference numeral in the above figures indicates the figure in which an element or feature is most prominently shown. The second digit indicates related elements or features, and a final letter (when used) indicates a sub-portion of an element or feature.

DETAILED DESCRIPTION OF THE INVENTION

Figure 2:
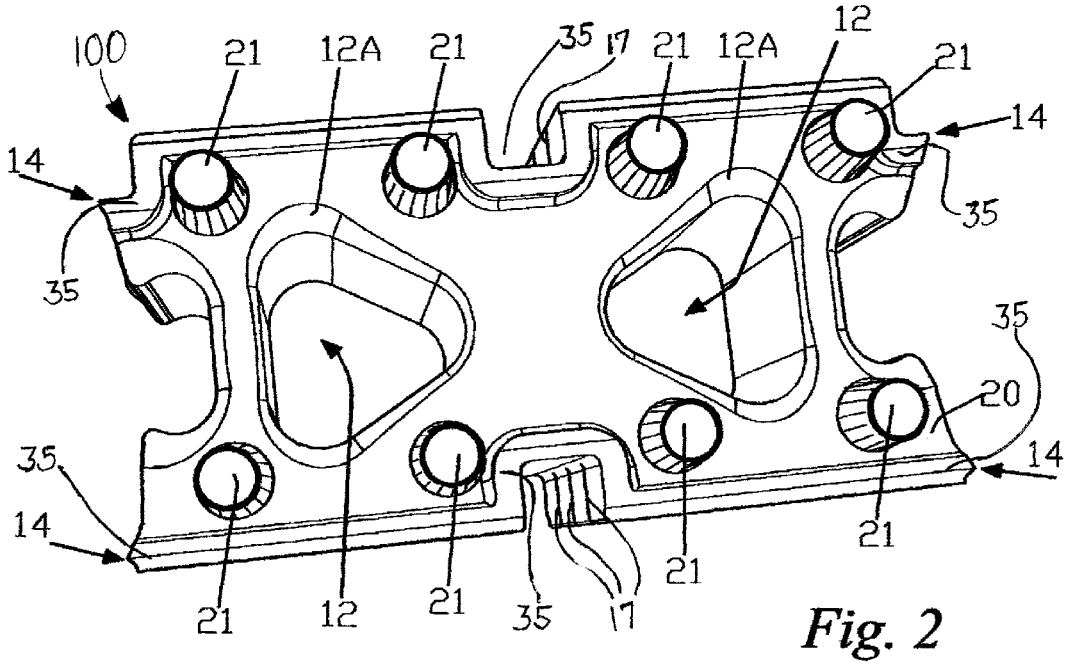
FIG. 2 illustrates a perspective view of the concave lower surface of the interlocking masonry unit of FIG. 1.
Figure 3:
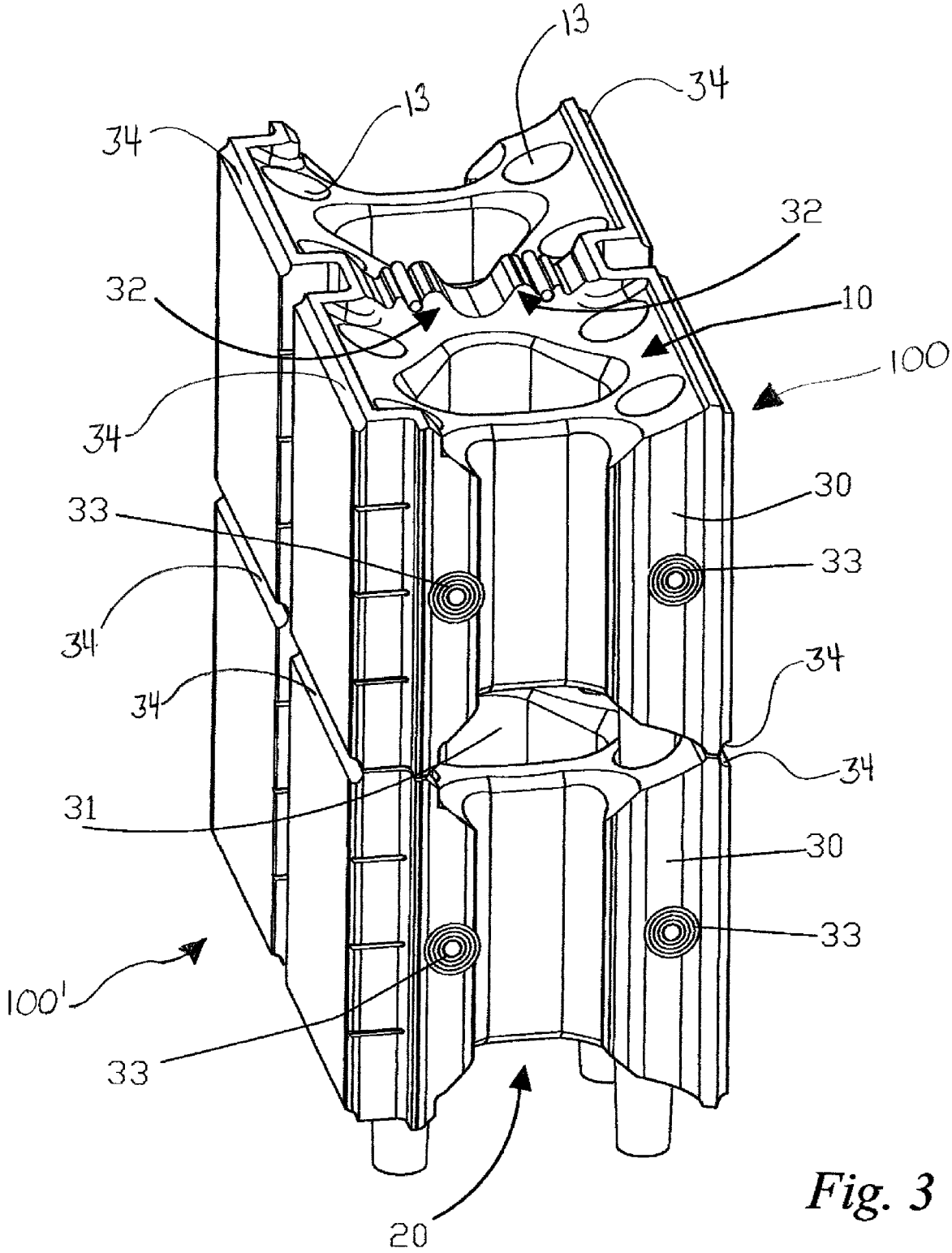
FIG. 3 illustrates an end plan view of two vertically adjacent interlocking masonry units according to an embodiment of the present invention. The masonry unit may be offset by one half block as desired to increase the strength and stability of a stack or wall.

FIGS. 1 and 2 illustrate a masonry unit according to a preferred embodiment of the invention, and is shown generally at reference numeral 100. FIG. 1 illustrates a perspective view of the concave upper surface and a side surface of the masonry unit 100. The masonry unit 100 comprises a generally rectangular prism shape with a concave upper surface 10 as shown in FIG. 1., a concave lower surface 20 as shown in FIG. 2, two side surfaces 11 as shown in FIG. 1, and two end surfaces 30 as shown in FIG. 3. One skilled in the art will recognize that any three dimensional object with a rectangular prism shape generally comprises six surfaces. The surface names, as used throughout the application, are chosen for purposes of designation rather than functionality and should not be considered limiting. The purpose of the concave shape of the upper surface 10 and lower surface 20 is discussed below in reference to FIG. 3.

The masonry unit 100 comprises one or more central vertical cavities 12, as shown in FIGS. 1 and 2. The central vertical cavities 12 should extend between the lower surface 20 and the upper surface 10 of the present invention and should be capable of accepting bonding material. In the preferred embodiment, two central vertical cavities 12 are employed, and each of the central vertical cavities 12 comprise the same shape mirrored about an axis passing through the center of the unit and perpendicular to the side surfaces 11.

In the preferred embodiment, the central vertical cavities 12 comprise a rounded triangular shape, however, many central vertical cavity 12 shapes could be substituted. When two or more interlocking masonry units 100, 100' are placed in a vertically adjacent position relative to one another, also referred to hereinafter as a stack as shown in FIG. 3., the central vertical cavities 12 of each masonry unit should be generally aligned with the central vertical cavities 12 of the other units. So long as the central vertical cavities 12 of each unit are generally the same shape and are generally aligned, any bonding material poured into a central vertical cavity 12 of the uppermost unit 100 will also pour through the corresponding central vertical cavity 12 of each unit below in the stack due to the force of gravity. This allows a craftsman to quickly create a wall by stacking the masonry units, one on top of one another, and then pouring bonding material through each vertical cavity as the wall is completed and judged to be in the proper shape and alignment. In the preferred embodiment, the central vertical cavities 12 are surrounded by a sloped edge 12A as shown in FIGS. 1 and 2, preferably at or near a forty five degree angle from the horizontal plane, to act as a funnel creating a larger void between the upper and lower masonry units, thus assisting the bonding material in its movement into the lower portions of the stack.

As shown in FIG. 2., the masonry unit 100 comprises a plurality of support members 21 projecting vertically out from the lower surface 20 of the masonry unit. Preferably, eight support members 21 are employed, however, a greater or fewer number of support members 21 can be employed. As shown in FIG. 1, the masonry unit comprises a plurality of receiving port depressions 13 each projecting vertically into the upper surface 10 of the masonry unit 100. Preferably, eight receiving port depressions 13 are employed. Each receiving port depression 13 can be shaped and positioned to be capable of receiving a corresponding support member 21 from another masonry unit. As such, multiple masonry units can be stacked one on top of another. When creating the stack, the support members 21 of the upper masonry unit are received by the receiving port depressions 13 on the upper surface 10 of the masonry unit immediately below it. In this manner, each masonry unit is effectively interlocked into position relative to the masonry units below. Absent manufacturing defects or variable terrain, the resulting stack is straight and level without requiring the user to undertake efforts to adjust or otherwise level the stack. As variable terrain and manufacturing irregularities are possible, the user can rapidly create a stack and quickly observe and correct any alignment concerns prior to pouring bonding material through the vertical cavities. Preferably, each receiving port depression 13 is larger than the support members 21 to allow the user to make minor adjustments to the wall as it is completed.

Figure 4:
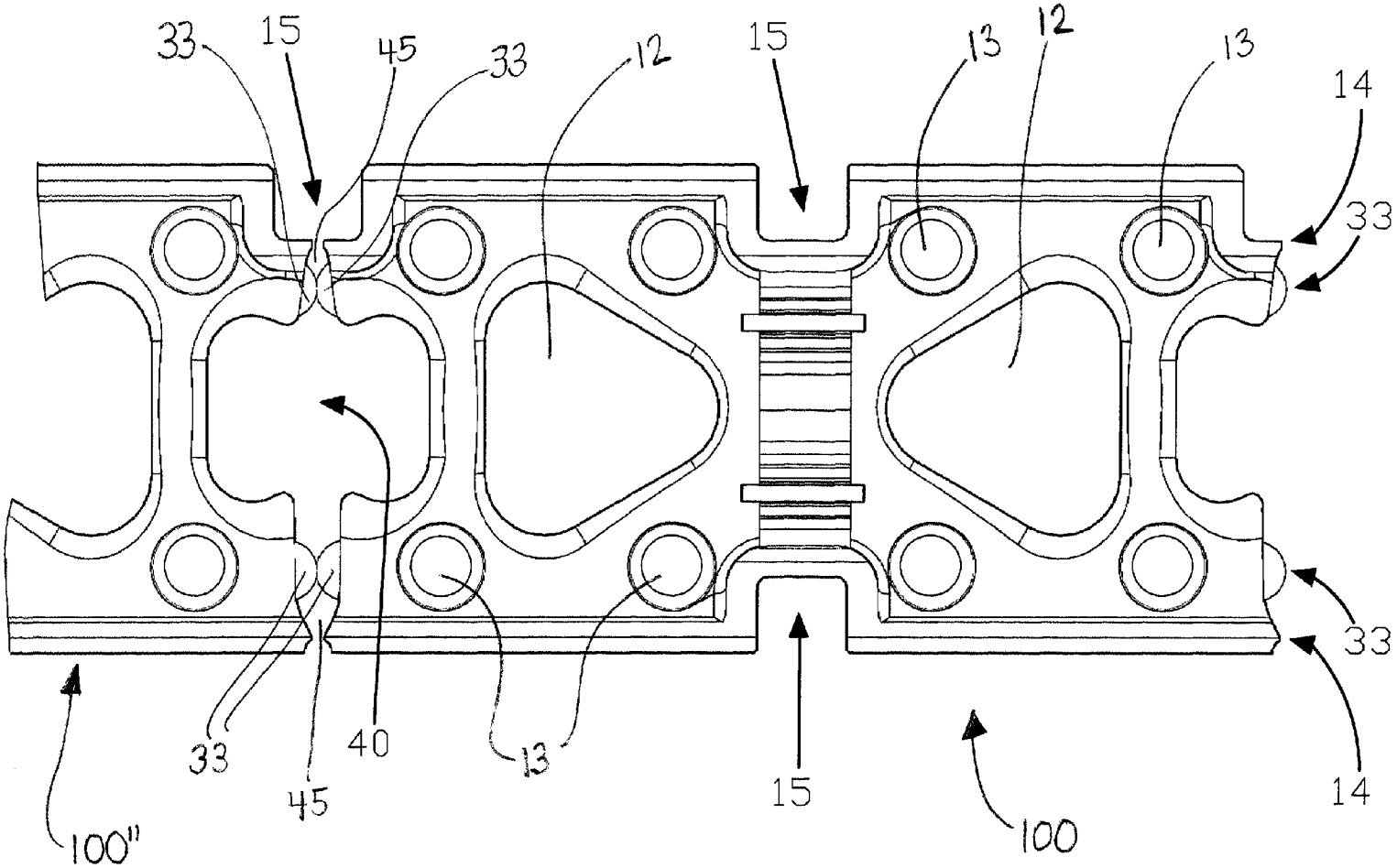
FIG. 4 illustrates a top plan view of a complete and a partial horizontally adjacent interlocking masonry unit according to an embodiment of the present invention.
Figure 5:
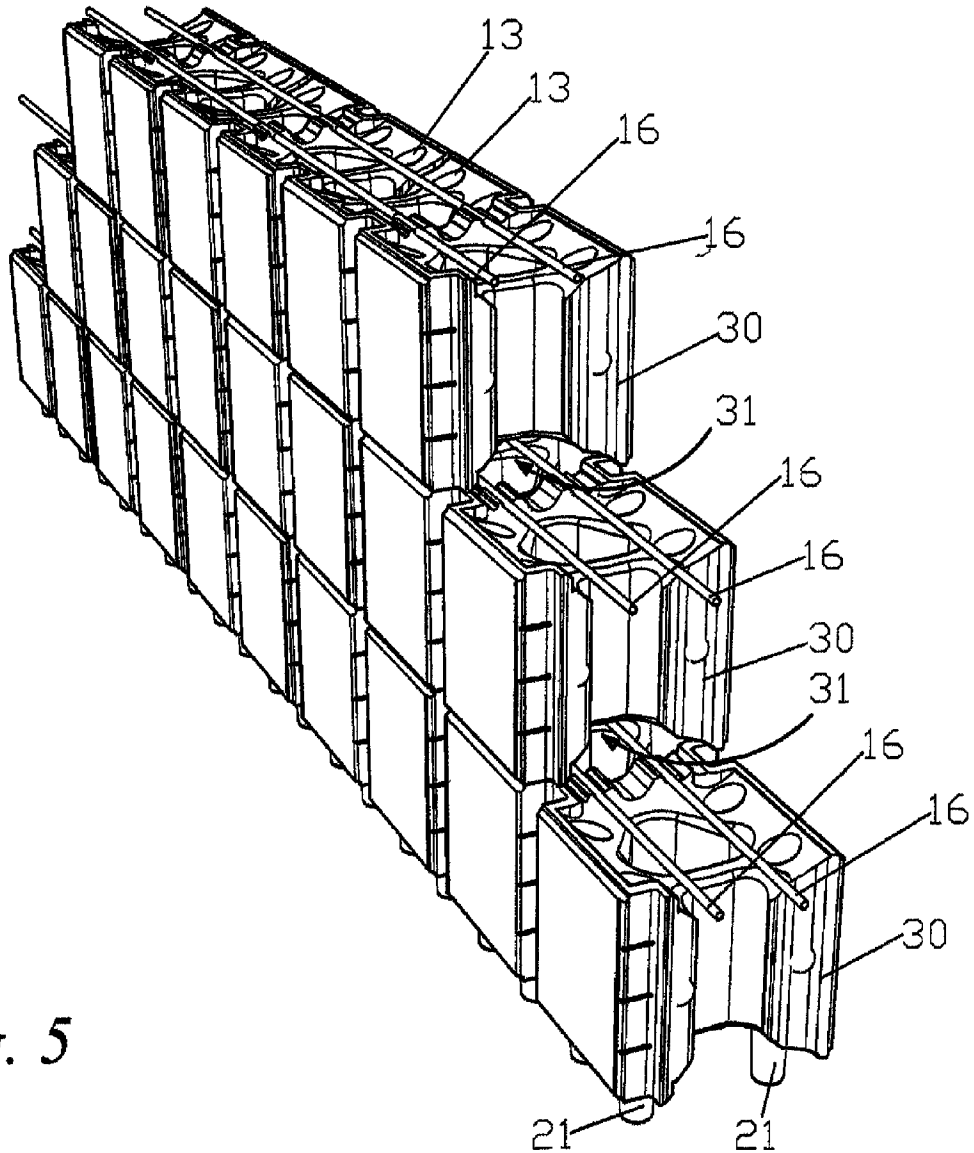
FIG. 5 illustrates perspective view of a wall comprising multiple masonry units according to an embodiment of the invention.

In a preferred embodiment, each end surface 30 as shown in FIG. 3 further comprises two end projections 14. As shown in FIG. 4., the end projections 14 can be shaped and positioned so that when two interlocking masonry units are placed in a horizontally adjacent configuration, an intermediate vertical cavity 40, as shown in FIG. 4, extending between the masonry units is created. When the masonry units are stacked in rows, the intermediate vertical cavity 40 can accept bonding material. So long as the masonry units are not offset, the bonding material can be capable of poured through an intermediate vertical cavity 40, as shown in FIG. 5, that is placed in a higher position in the stack to intermediate vertical cavities 40 that are placed lower in the stack due to the force of gravity. However, even in an offset configuration, as can be seen in FIG. 5, the bonding material can be poured into each intermediate vertical cavity 40 from the central cavity 12 above it, due to the shape and positioning of the central cavities 12. Each of the end projections 14 include a sloped edge 14A, as shown in FIG. 1, preferably at or near a forty five degree angle from the horizontal plane, to act as a funnel and assist the bonding material in its movement into the lower portions of the stack. The end projections 14 should be omitted on the end surface 30 of any masonry unit that is to be used at the corner of a wall. It should also be noted that, in the preferred embodiment, portions of each block end come in contact with an adjacent block. This allows for proper alignment and spacing which maximizes amount of bonding material to attach between each unit to strengthen the bond. It should also be noted that, preferably, the shape of the intermediate vertical cavity 40 is irregular. This configuration increases the surface area available for the bonding material to attach to for a stronger bond. This configuration also ensures that the end projections 14 each attach around the cured bonding material contained in the vertical cavity 40, which further reduces the possibility of a breach in the wall, even if the bonding material should become separated from the associated masonry unit.

As shown in FIGS. 1 and 4, the masonry unit 100 can include one or more vertical depressions 15 in one or both of the side surfaces 11. Preferably, each vertical depression 15 has a width greater than one-half inch and less than two inches. Preferably, each vertical depression 15 projects into the masonry unit 100 between one-half inch and two and a half inches, and each vertical depression 15 also preferably extends down the entire side surface 11 of the masonry unit. When crafted to these preferred dimensions, each vertical depression 15 is capable of accepting a wall stud. The vertical depressions can further comprise a plurality of stud support notches 17, as shown in FIGS. 1 and 2. Each of the stud support notches 17 can be capable of accepting a peg to hold a wall stud in place. When a wall is finalized, a wall stud can be inserted into the vertical depression 15 and secured in position by means of plurality of pegs or similar items hammered or screwed into the stud support notches 17. In an alternate embodiment, no support notches 17 are provided and the wall studs can be secured by a toggle bolt or other securing means. This allows the user to create a wooden wall, capable of accepting drywall or similar finishing material without the structure that is typically associated with a standard wall. Referring to FIG. 4, the end projections 14 may also be shaped and positioned to create a vertical depression 15 in the side surface 11 between two horizontally adjacent interlocking masonry units 100, 100" that are capable of accepting a wall stud. This ensures that in the case of stacked rows where one or more rows are offset by half a masonry unit from one another, the vertical depression 15 in the side surface 11 of a masonry unit lines up with the vertical depression 15 created between two horizontally adjacent masonry units on a different row. This allows a wall stud to be accepted into all of the rows at once. Preferably, the vertical depressions 15 are positioned to create a distance of eight inches between the center of each wall stud and the center of the horizontally adjacent wall studs, once said wall studs are accepted. This allows the user to easily attach standard building materials to the wall studs.

FIG. 3 illustrates an end plan view of two vertically adjacent interlocking masonry units 100, 100'. In the preferred embodiment, the concave upper surface 10 of the lower masonry unit and the concave lower surface 20 of the upper masonry are shaped to create a horizontal cavity 31 which extends between the two masonry units. The horizontal cavity 31 is capable of accepting bonding material poured from upper rows through the vertical cavities and channeling the bonding material horizontally between two rows in the wall. The channel created by the horizontal cavity 31 and the vertical cavities 12 create a matrix of cured bonding material which increases the overall strength of the wall in relation to standard cinderblock walls. The channel created by the horizontal cavity 31 also allows bonding material to pour into the intermediate vertical cavities 40 in cases where the rows of the wall are offset. An end surface 30 of any masonry unit that is to be used at the corner of a wall can include an additional projection on the upper surface 10 and the lower surface 20 capable of closing the horizontal cavity 31 and vertical cavity 40 preventing any bonding material from escaping from the channel created by the horizontal cavities 31 of the masonry units 100, 100' in the wall.

In a preferred embodiment, the upper surface 10 further comprises a plurality of upper projections 32 as shown in FIG. 3. The upper projections 32 can accept one or more reinforcing elements 16, as shown in FIG. 1 and FIG. 5, such as concrete reinforcing bar, also known as rebar, and/or similar items. The vertical channels created by the central vertical cavities 12 are also capable of accepting one or more reinforcing elements 16. The presence of the reinforcing elements 16 increases the overall structural integrity of the resultant wall after the bonding material is poured inside and allowed to cure. The matrix of vertical and horizontal channels associated with a wall constructed with the interlocking masonry units, as described herein, along with associated reinforcing elements 16, creates a structural integrity that is significantly increased over a standard cinder block wall.

In a preferred embodiment, the masonry unit 100 has sharp edges 35 at the outer perimeter at the top and bottom and on both ends of the masonry unit 100, as shown in FIGS. 1 and 2. The sharp edges 35 form one-half of a mortar seam. The edge 35 slopes inward, toward the center of the masonry unit 100 to form a V or pinch point 45, as shown in FIG. 4, between masonry units 100, 100", when the units are stacked end to end and/or one on top of the other. This pinch point 45 preferably should be approximately one-sixteenth to one eighth inch in width. This pinch point 45 is shaped similar to a funnel to guide the bonding material from a wide area or space to the narrow space where the grit, sand and gravel of the bonding material fill in, forcing out air from the masonry units and sealing the space, bonding the units together. In addition, the masonry unit 100 can have sloped, concave outer edges 34, as shown in FIG. 3.

In a preferred embodiment, each end projection 14 further comprises a bumper projection 33. As can be seen in FIG. 4, each bumper projection 33 is shaped and positioned to come in contact with a bumper projection 33 of an equivalent horizontally adjacent interlocking masonry unit when the masonry units are being placed by the user. In this manner, the user may place each masonry unit, verify the bumper projections 33 of each masonry unit are properly touching, and thereby verify that the row of masonry units being created is level and aligned. The bumper projections 33 hold the blocks of the masonry units apart a pre-determined distance, as shown at reference numeral 45 in FIG. 4. Preferably, the bumper projections 33 create a space 45 of approximately one-sixteenth to one-eighth inch wide. This space 45 lets the air out when the masonry units are being filled with bonding material. The grit, rock and sand that is part of the bonding material fills the internal block voids are stopped from exiting at this point FIG. 5 illustrates perspective view of a wall comprising multiple masonry units according to a preferred embodiment of the invention. A method of assembling a wall comprising interlocking masonry units as depicted in FIG. 5 is now more fully described. A row of interlocking masonry units can be created by placing a plurality of interlocking masonry units on a prepared surface in a manner that causes the end surface 30 of each masonry unit to come in contact with an end surface 30 of one or more adjacent masonry units. Subsequent rows of interlocking masonry units can be positioned on top of the previously created row of interlocking masonry units by placing the support members 21 of the masonry units in the subsequent row into the receiving port depressions 13 of the previously placed row. This process can be repeated until a wall or structure of the desired height is created. Reinforcing elements 16 can be placed into the horizontal cavities 31 between each row. Depending on the embodiment, the user may shift each subsequent row by half of the length of a masonry unit in the horizontal axis from the previously placed row to increase the stability of the resultant wall. The reinforcing elements 16 can be placed in the horizontal cavities 31 prior to placing any associated corner units. Reinforcing elements 16 should also be placed into the central vertical cavities 12 and 40 of each masonry unit for greater structural integrity. Bonding material can be poured into the vertical cavities and allowed to spread and seep into the horizontal cavities to create a matrix of bonding material throughout the cavities of the wall. A mechanical means may be employed to vibrate and to assist the bonding material in its spread throughout the matrix of cavities in the structure. The bonding material should then be allowed to cure in the wall. In an alternate embodiment, bonding material can be poured into the cavities after each row is positioned.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. The foregoing description of the preferred embodiment of the invention and the best mode for practicing the invention are provided for the purpose of illustration only and not for the purpose of limitation—the invention being defined by the following claims and equivalents thereof.

I claim:

1. An interlocking masonry unit, comprising:

a body comprising a lower surface having a concave section, an upper surface having a concave section and at least one side wall intermediate the lower surface and the upper surface;

at least one central vertical cavity extending between the lower surface and the upper surface and capable of accepting bonding material;

a plurality of support members projecting vertically out from the concave section of the lower surface; and a plurality of receiving port depressions projecting vertically into the concave section of the upper surface, each receiving port depression being shaped and positioned to be capable of receiving one of the plurality of support members, whereby the plurality of support members can be received in the plurality of receiving port depressions of an equivalent vertically adjacent interlocking masonry unit.

2. The interlocking masonry unit of clam 1, wherein each of the plurality of support members has a length greater than a depth of each of the plurality of receiving port depressions whereby a space is maintained between the masonry unit and the equivalent vertically adjacent masonry unit to provide ventilation between the masonry unit and the equivalent vertically adjacent masonry unit.

3. The interlocking masonry unit of claim 2, wherein the concave upper surface and the concave lower surface are shaped to create a horizontal cavity extending between said masonry unit and an equivalent vertically adjacent interlocking masonry unit, said cavity being capable of accepting bonding material.

4. The interlocking masonry unit of claim 3, wherein the at least one side wall comprises first and second opposite side surfaces and first and second opposite end surfaces, and the first and second opposite end surfaces each comprise two end projections.

5. The interlocking masonry unit of claim 4, wherein the end projections of the first end surface and the end projections of the second end surface are shaped and positioned to create an intermediate vertical cavity extending between said masonry unit and an equivalent horizontally adjacent interlocking masonry unit, said cavity being capable of accepting bonding material, and having an irregular shape.

6. The interlocking masonry unit of claim 5, wherein the end projections of the end surfaces are shaped and positioned to attach around cured bonding material contained by the intermediate vertical cavity.

7. The interlocking masonry unit of claim 5, wherein the intermediate vertical cavities each comprise a sloped edge.

8. The interlocking masonry unit of claim 4, wherein the end projections of the end surfaces are shaped and positioned to create a vertical depression in a side surface between said masonry unit and an equivalent horizontally adjacent interlocking masonry unit, said vertical depression being capable of accepting a wall stud.

9. The interlocking masonry unit of claim 1, further comprising one or more vertical depressions projecting into a side surface for accepting a wall stud.

10. The interlocking masonry unit of claim 9, wherein the vertical depressions further comprise a plurality of stud support notches, each capable of accepting a peg to hold a wall stud in place.

11. The interlocking masonry unit of claim 3, wherein the upper surface further comprises a plurality of upper projections capable of accepting one or more reinforcing elements.

12. The interlocking masonry unit of claim 1, wherein the central vertical cavities are capable of accepting one or more continuous reinforcing elements.

13. The interlocking masonry unit of claim 4, wherein the end projections further comprise bumper projections shaped and positioned to come in contact with the bumper projections of an equivalent horizontally adjacent interlocking masonry unit.

14. The interlocking masonry unit of claim 1, wherein the lower surface comprises eight support members and the upper surface comprises eight receiving port depressions.

15. The interlocking masonry unit of claim 1, wherein the central vertical cavities each comprise a sloped edge to facilitate flow of bonding material.

* * * * *